US005123456A

United States Patent [19]

Jansen

[11] Patent Number: 5,123,456

[45] Date of Patent: Jun. 23, 1992

[54] BANDING TOOL WITH INCLUDING CLAMPING PLUNGER

[75] Inventor: George A. Jansen, Denver, Colo.

[73] Assignee: Band-It-Idex, Inc., Denver, Colo.

[21] Appl. No.: 593,124

[22] Filed: Oct. 5, 1990

[51] Int. Cl.[5] ..... B21F 9/02

[52] U.S. Cl. ..... 140/93.4; 140/123.6; 140/150

[58] Field of Search ..... 140/93.2, 93.4, 123.6, 140/150, 152, 153, 154; 81/9.3

[56] References Cited

U.S. PATENT DOCUMENTS

| | | | |
|---|---|---|---|
| 1,482,247 | 1/1924 | Nowland | 140/93.4 |
| 1,555,819 | 10/1925 | Baruch | 140/93.4 |
| 1,712,037 | 5/1929 | Halter | 140/93.4 |
| 2,087,655 | 7/1937 | Prestwich | 81/9.1 |
| 2,214,110 | 9/1940 | Ott | 140/93.2 |
| 2,324,609 | 7/1943 | Watt et al. | 140/93.2 |
| 2,643,687 | 6/1953 | Schlage et al. | 140/93.4 |
| 3,152,621 | 10/1964 | Meier | 140/123.6 |
| 3,241,579 | 3/1966 | Partridge | 140/123.6 |
| 4,056,128 | 11/1977 | Konrad | 140/93.4 |
| 4,646,393 | 3/1987 | Young | 24/20 |
| 4,726,403 | 2/1988 | Young et al. | 140/93.4 |
| 4,928,738 | 5/1990 | Marelin et al. | 140/93.4 |

FOREIGN PATENT DOCUMENTS

| | | | |
|---|---|---|---|
| 658135 | 2/1963 | Canada | 140/117 |

*Primary Examiner*—Lowell A. Larson
*Attorney, Agent, or Firm*—Sheridan Ross & McIntosh

[57] ABSTRACT

A banding tool (10) is provided to tension and lock a band (12) and a buckle (14) around an object (16). The tool (10) has a housing (18) and a pull-up/cut-off handle (20) for cooperatingly tensioning the band (12). Upon properly tensioning the band (12) around the object (16), the handle (20) is further manipulated to engage a locking/cutting lever (26). The lever (26) engages a head (42) which holds a punch (46) therein and includes a surface (49). The punch (46) first contacts the band (12) to deform and lock the band (12) to itself. The surface (49) of the head (48) then bends and cuts the tail (134) from the band (12).

25 Claims, 11 Drawing Sheets

BANDING TOOL WITH INCLUDING CLAMPING PLUNGER

TECHNICAL FIELD OF THE INVENTION

This invention relates in general to banding tools, and in particular to a method and apparatus for tensioning a band with a tool having an included clamping plunger.

BACKGROUND OF THE INVENTION

Banding tools are well-known in the art for applying tension to a band around an item to be connected or held together. Banding tools are often bulky and difficult to operate due to their size. Some banding tools are designed to be more compact and easy to operate, however, these tools tend to become more complex.

Additionally, there are several various types of bands and clamps available, for example, free/open end clamps and pre-formed clamps. Pre-formed clamps are manufactured to close tolerances and therefore already partially retain the band within the buckle thereof. The free/open end clamps, however, are formed with a looser tolerance between the buckle and the band. Therefore, there is no tendency for the buckle to hold the band therein without some interaction between a tool, the band and the buckle.

Such interaction may comprise bending of the band around a buckle and/or crimping the buckle to the band. Typically tools that work with free/open end clamps require the use of a plurality of separate devices to tension and then fasten the band to the buckle. Thus, whereas the free/open end clamps are generally cheaper to manufacture and easier to handle than pre-formed clamps, additional tool requirements tend to degrade their usefulness.

One example of the use of a separate tool to secure a buckle to a band is disclosed in U.S. Pat. No. 3,754,303 to Pollock, Aug. 28, 1973. In Pollock, a separate blunt-nosed punch is used in conjunction with a mallet to secure the buckle and the band around a hose or other flexible tubing. Thus it is necessary to use one device to tension the band, one device to deform the band and one device to provide the force to deform the band.

Another such clamp is disclosed in U.S. Pat. No. 3,833,969 to Hollingsworth et al., Sep. 10, 1974. After the band is tensioned around a hose and the buckle is properly positioned, a punch 20 is struck with a hammer to deform the buckle. Therefore, it is necessary to again use additional tools beyond the tensioning tool to secure the band and buckle around the hose. Thus, there is a need for a method and apparatus to tension and secure a free/open end band clamp without the necessity of additional tools.

SUMMARY OF THE INVENTION

The present invention disclosed herein comprises a method and apparatus for tensioning and securing a free/open end band clamp which substantially eliminates or reduces problems associated with prior free/open end band clamp tools. The present invention allows a free/open end band clamp to be tensioned about an object and locked in place without the necessity of additional accessory tools.

In one aspect of the present invention, a banding tool for use with a free/open end band clamp is provided. The tool comprises a tensioning portion and a slippage prevention portion. A punch is provided within the tool to form a locking deformation on the band which interacts with a buckle thereof. Additionally, a bending and cutting assembly is provided to first bend and then sever the tail of the band from the tensioned band clamp.

In another aspect of the present invention, the tensioning portion comprises an eccentric wheel mounted in a sliding housing. A handle is linked to the sliding housing to actuate the tensioning portion. Upon actuation the wheel grips a band to be tensioned and the sliding housing pulls the band into a gradually increasing state of tension around the object.

The slippage prevention portion comprises a spring biased pivoting lever arm. As the tensioning portion pulls the band, the lever arm pivots against the spring bias to allow the band to pass. Once the tensioning portion releases the band, the lever arm is biased into contact with the band to securely hold it in position.

The punch is interconnected to the handle through linkage to allow deformation of the band thereby. Once the punch deforms the band into the buckle, the bending and cutting assembly severs the tail from the band and thus completes the operation.

It is a technical advantage of the present invention that a banding tool is provided with an included clamping plunger. It is no longer necessary to use separate tools to tension the band and to secure the band to the buckle.

BRIEF DESCRIPTION OF THE DRAWINGS

For a more complete understanding of the present invention and for further advantages thereof, reference is now made to the following Detailed Description taken in conjunction with the accompanying Drawings, in which.

DETAILED DESCRIPTION OF THE INVENTION

Figure 1:
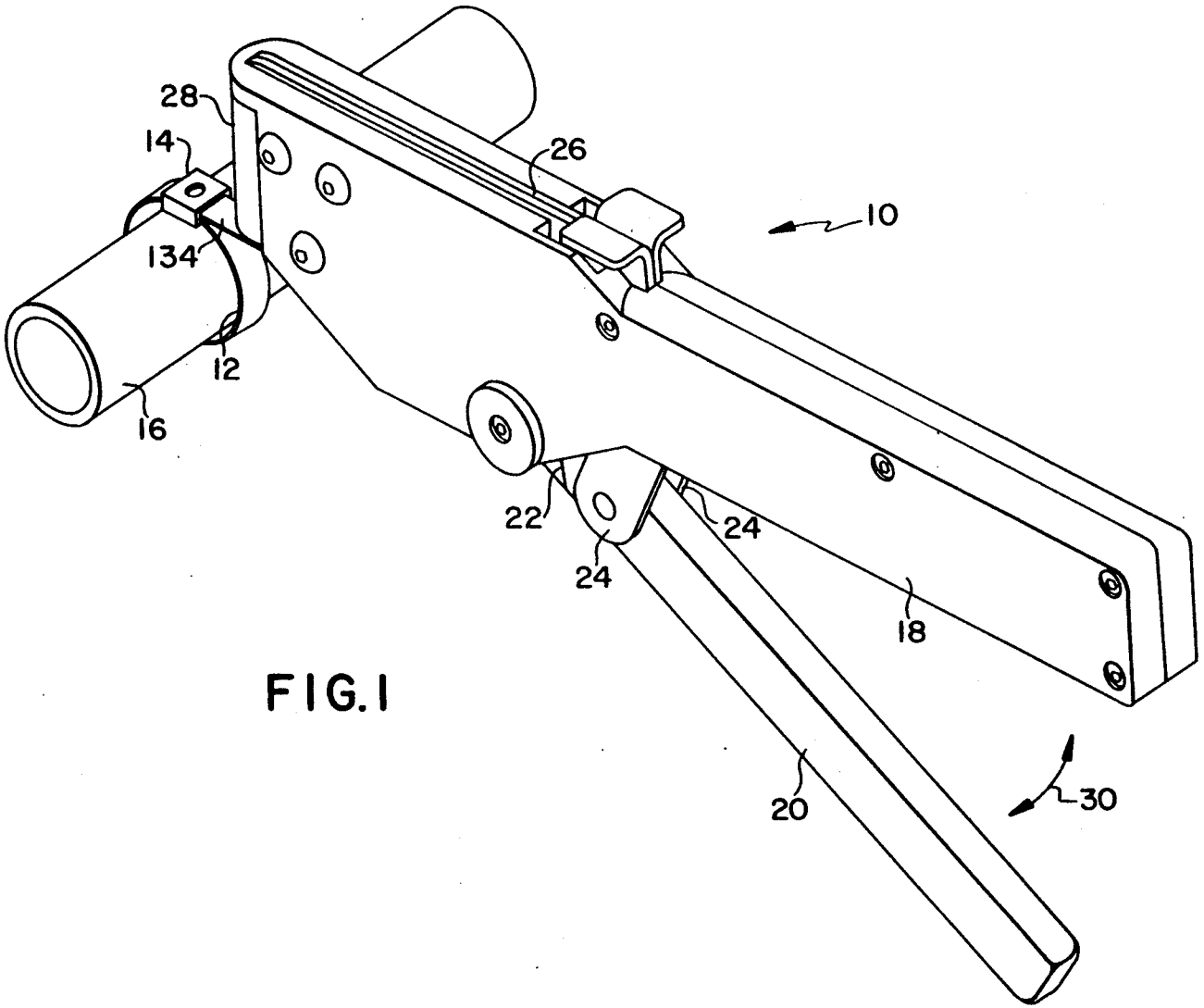
FIG. 1 is a perspective view of a banding tool constructed in accordance with the preferred embodiment of the present invention in use with a band clamp.

Referring to FIG. 1, a banding tool constructed in accordance with the preferred embodiment of the present invention is generally identified by the reference numeral 10. The tool 10 is used to tension a band 12 and a buckle 14 thereof around an object 16. The band 12 and the buckle 14 are of the free/open end type which allow the band 12 to pass freely through the buckle 14 until some positive step is taken to cause the buckle 14 to lock the band 12 in place. As is well-known in the art, the object 16 may comprise, for example, an electrical cable with a protective coating or a pair of concentric tubes.

The tool 10 comprises a main body housing 18 which serves as part of a gripping device and a housing for the various components of the tool 10. A pull-up/cut-off handle 20 is pivotally attached to the main body housing 18.

A spring 22 is attached between the housing 18 and the handle 20 for use in the tensioning operation. A pair of pull-up/cut-off links 24 are pivotally attached to the handle 20 and to a slide assembly, as will be subsequently described in greater detail, within the housing 18. A locking/cutting lever 26 is operably connected to the housing 18, as will be subsequently described in greater detail.

In operation, the band 12 is wrapped around the object 16 and then inserted through the buckle 14. A tail 134 of the band 12 is inserted into the tool 10 at a front end 28 thereof. The tool 10 is then grasped by the housing 18 and the handle 20 and through a series of back-and-forth motions of the handle 20 in a direction indicated by a double headed arrow 30, the tool 10 tensions the band 12 around the object 16. Upon reaching a desired tension, the handle 20 is manipulated to activate the locking/cutting lever 26 to lock the band 12 to the buckle 14 and to sever the tail 134 of the band 12 therefrom.

Figure 8C:
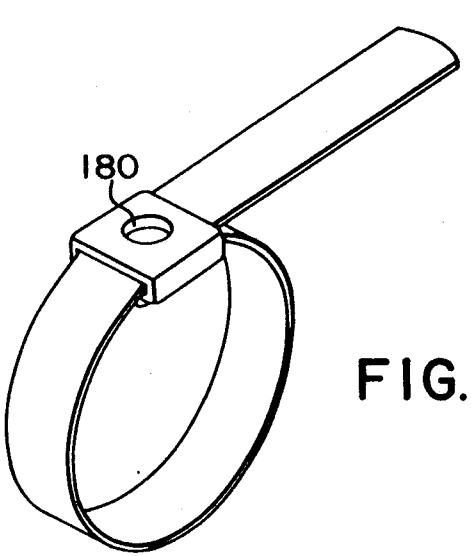
FIGS. 8*a, b, c* and *d* are isometric views of the band and buckle used with the present invention.
Figure 8D:
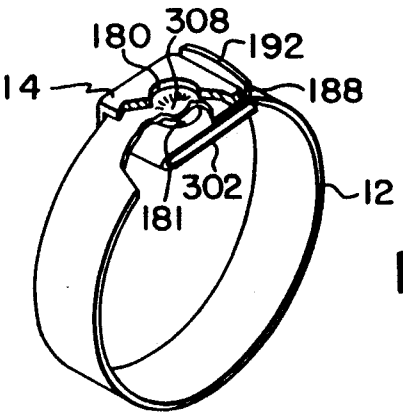
Figure 8B:
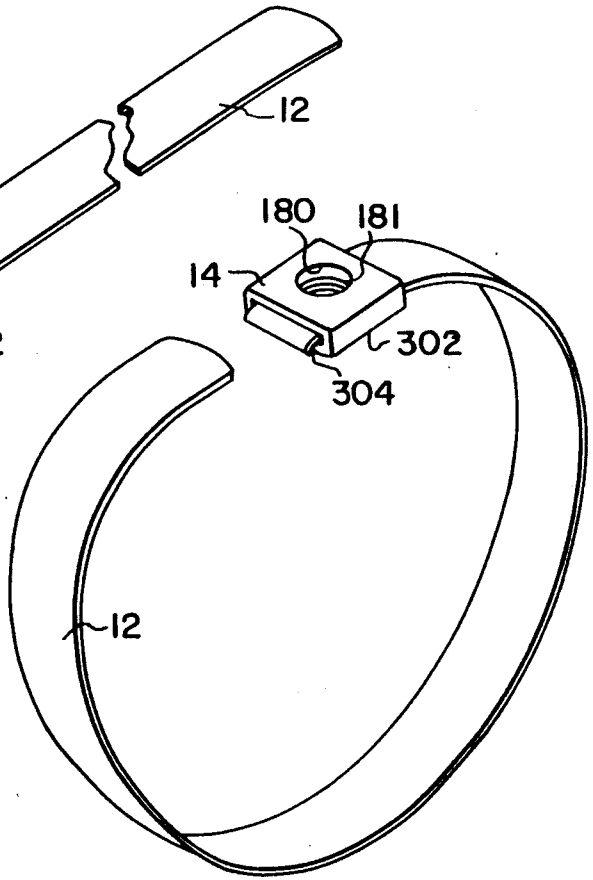
Figure 8A:
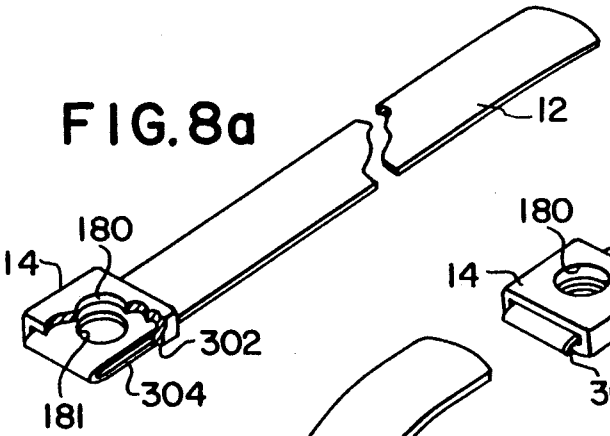

Referring simultaneously to FIGS. 8*a*, 8*b*, 8*c* and 8*d*, isometric views of the band 12 and the buckle 14 are shown. Referring first to FIG. 8*a*, the band 12 is shown prior to use with the buckle 14 partially cut away. The buckle 14 comprises a flat strip bent around the band 12 to generally conform to the shape thereof. A first hole 180 is formed through the buckle 14. The band 12 is inserted through the buckle 14 and bent back around a bottom portion 302 of the buckle 14 forming a short connecting strip 304. A hole 181 is formed in the band 12 directly below the first hole 180 of the buckle 14.

Referring to FIG. 8*b*, to place the band 12 around an object 16 (see FIG. 1), the band 12 is formed into a loop for insertion into the buckle 14 as shown in FIG. 8*c*. The band 12 is then inserted into the tool 10 for tensioning, as shall be subsequently described in greater detail. Upon reaching the proper tension, the tool 10 is activated to lock the band 12 to the buckle 14. The locking action forms a dimple or deformation 308 (see FIG. 8*d*) which causes the deformation 308 to interlock with the hole 181 in the band 12. A tail (not shown) is also cut from the band 12 by the tool 10 to form a full locking lip 188 having an arcuate edge 192.

Figure 2:
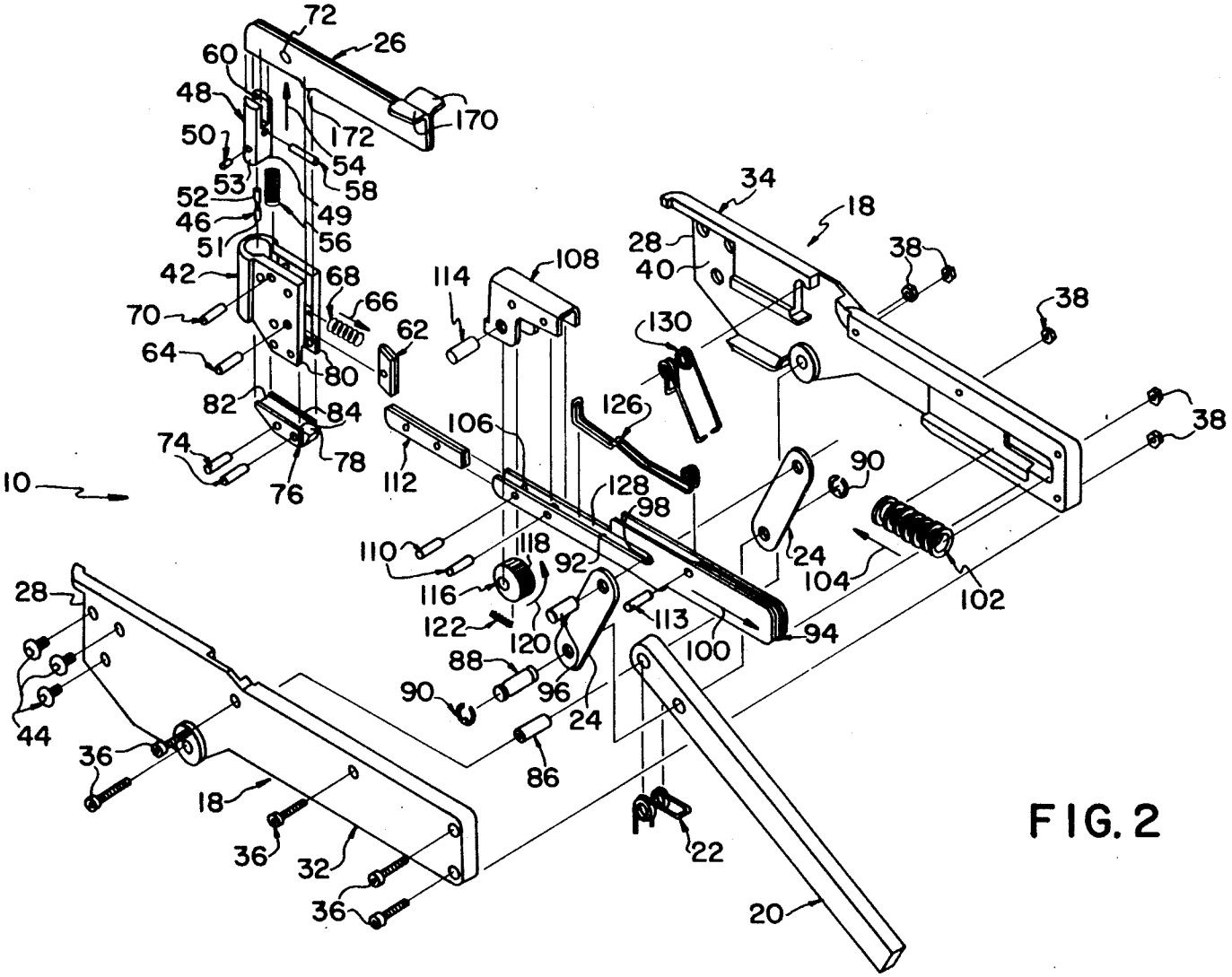
FIG. 2 is an exploded perspective view of the banding tool of FIG. 1.

Referring to FIG. 2, an exploded perspective view of the banding tool 10 of FIG. 1 is shown. The main body housing 18 comprises a left side 32 and a right side 34 which is a mirror image thereof. The left side 32 and right side 34 are held together by a plurality of socket head screws 36 and nuts 38 passing therethrough.

Within a recess 40 proximate the front end 28 of the housing 18 is a head 42 which is fixed therein by a plurality of button head screws 44. Fixed within the head 42 is a punch 46 and a cutter/punch holder 48. The punch 46 is held within the holder 48 by a pin 50 which interfaces with a reduced diameter portion 52 on the punch 46. The punch 46 is positioned within the holder 48 so that a punching end 51 protrudes beyond a bottom surface 53 of the holder 48 in order to allow deformation of the band 12 prior to cutting thereof.

The holder 48 and the punch 46 are biased in a direction indicated by an arrow 54 by a spring 56 which interfaces with a pin 58 mounted in the holder 48. Thus, the holder 48 and punch 46 are biased in the direction 54 by the spring 56 until the spring 56 is counteracted by the locking/cutting lever 26. The holder 48 also has a bending/cutting edge 49, as will be subsequently described in greater detail.

The locking/cutting lever 26 fits within a slot 60 of the holder 48 and is pivotally mounted therein by a pin 70 passing through a hole 72 in the lever 26. The locking lever 26 also comprises a pair of flanges 170 and an extension 172, as will be subsequently described in greater detail. Also received by the head 42 is a holding dog 62 which is pivotally mounted therein by a pin 64. The holding dog 62 is biased in a direction indicated by an arrow 66 by a spring 68.

Fixed within the head 42 by pins 74 is a nose 76. A top surface 78 and rails 84 of the nose 76 cooperate with flanges 80 in the head 42 to receive, guide and center a band 12 (see FIG. 1). The nose 76 also provides an edge 82 for cooperation with the bending/cutting edge 49 of the cutter/punch holder 48 to bend and cut the band 12, as will be subsequently described in greater detail. The top surface 78 cooperates with the holding dog 62 to retain the band 12 against back slippage during tensioning thereof.

Pivotally mounted to the housing 18 by a tube spacer 86 and one of the screws 36 is the pull-up/cut-off handle 20. Pivotally mounted to the handle 20 by a pin 88 and retaining rings 90 are the pull-up/cut-off links 24. At an end opposite the pivotal attachment to the handle 20, the links 24 are slidably attached within a slot 92 of a pull-up slide 94 by a pin 96. The pin 96 normally presses against an end 98 of the slot 92 to move the pull-up slide 94 in a direction indicated by an arrow 100. To move the slide 94 in the direction 100, the handle 20 and link 24 must overcome the bias of a spring 102 which tends to force the slide 94 in a direction indicated by an arrow 104.

At an extension end 106 of the slide 94 is a gripper holder 108 fixed thereto by pins 110. Positioned in a slot 128 in the extension end 106 of the gripper holder 108 is a gripper slide spacer 112 held therein by the pins 110. Rotatably mounted to the gripper holder 108 by a pin 114 is a gripper pull-up wheel 116. The gripper pull-up wheel 116 comprises a roughened or knurled perimeter 118 which is eccentric about the pin 114. The wheel 116 is biased in a direction indicated by an arrow 120 by a spring 122 which fits in a slot 124 (see FIG. 3).

A spring 126 is held by a pin 113 within the slot 128 in the pull-up slide 94 abutting the space 112 for cooperation with the pin 96 riding within the slot 92. A spring 130 is received within a slot 132 of the housing 18 for interaction with the links 24 and pin 96, as will be subsequently described in greater detail.

Figure 3B:
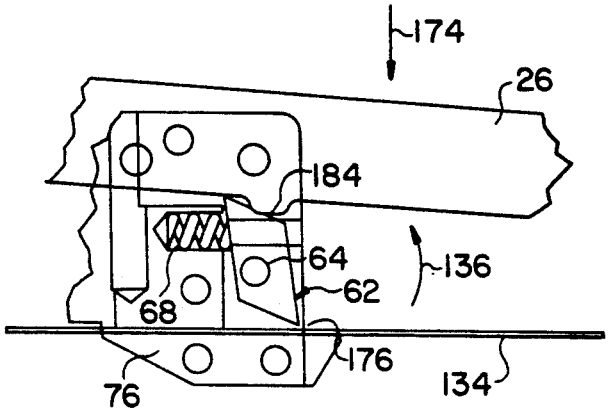
FIGS. 3*a, b* and *c* are a cross-sectional views of the banding tool being loaded.
Figure 3A:
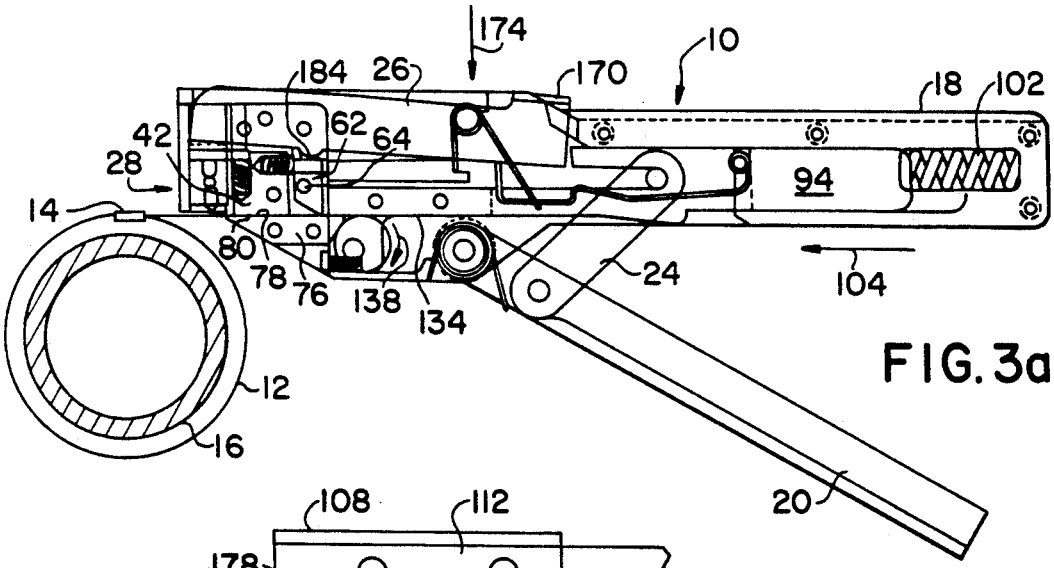

Referring to FIG. 3*a*, a side elevation of the tool 10 is shown with the left side 32 of the housing removed. In the normal position, as shown in FIG. 3*a*, the handle 20 is spaced apart from the housing 18 by the spring 102, and the holding dog 62 is biased by the spring 68 into contact with the top surface 78 of the nose 76. Additionally, the gripper pull-up wheel 116 is pushed by the nose 76 against the bias of the spring 122 out of contact with the gripper slide spacer 112. The pull up slide 94 is biased in the direction 104 by the spring 102.

To install band clamp, the band 12 is first wrapped around the object 16 and then inserted into the buckle 14. A tail 134 is then pushed into the tool 10 at the front end 28 thereof. The tail 134 is inserted between the flanges 80 of the head 42 and the rails 84 of the top surface 78 of the nose 76.

As the tail 134 is pushed into the tool 10, the tail 134 contacts the holding dog 62 (see FIG. 3*b*). However, by pressing downwardly as indicted by an arrow 174 on the flanges 170 of the lever 26, the extension 172 of the lever 26 contacts the holding dog 62 which is pivoted about the pin 64 against the spring 68 in a direction indicated by an arrow 136. Thus a gap 176 is opened between the dog 62 and the nose 76 to allow the tail 134 to pass freely thereby.

Figure 3C:
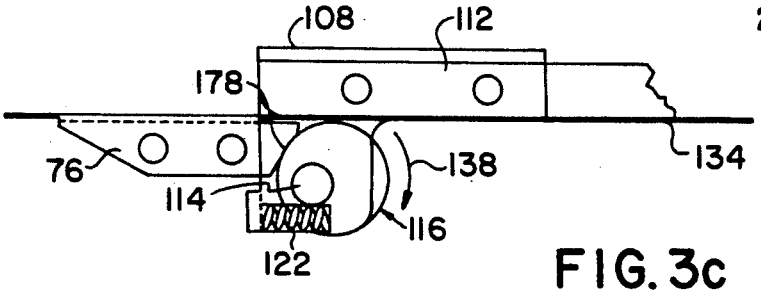

Once past the holding dog 62, the tail 134 passes between the wheel 116 and the gripper slide spacer 112 (see FIG. 3*c*). The wheel 116 is already pivoted about the pin 114 against the bias of spring 122 by an angled edge 178 of the nose 76 in a direction indicated by an arrow 138. The tail 134 continues past the wheel 116 and exits the housing 18 proximate the pull-up/cut-off link 24.

Figure 4C:
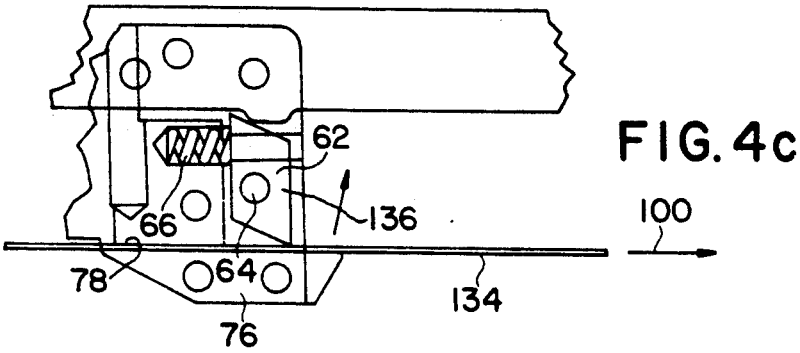
FIGS. 4*a, b* and *c* are cross-sectional views of a band being advanced through the tool.
Figure 4A:
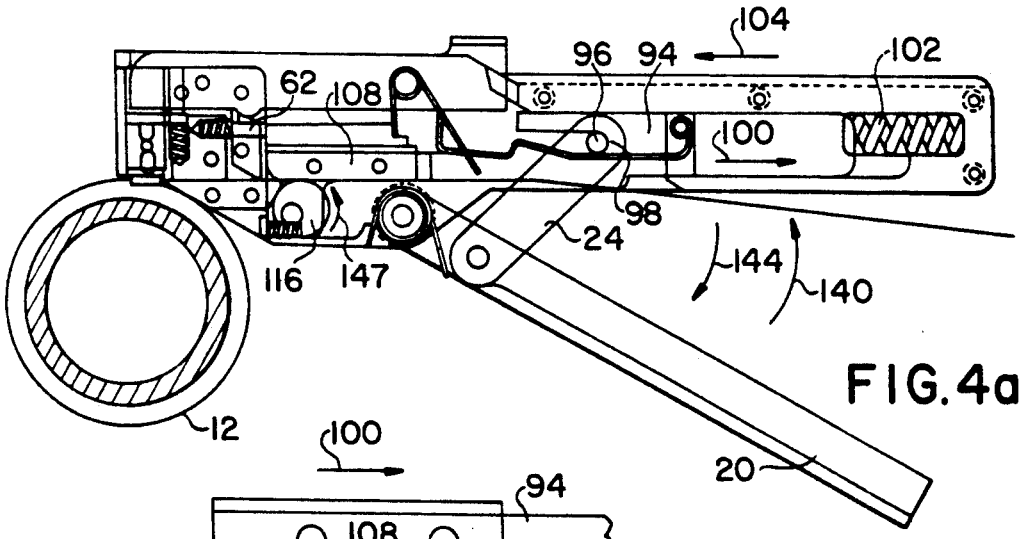
Figure 4B:
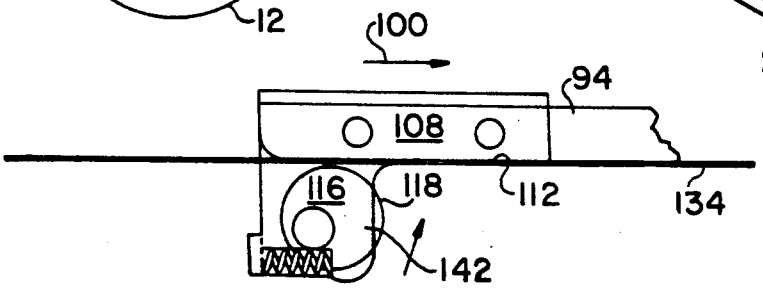

Referring to FIG. 4*a*, the tool 10 is shown with the band 12 being tensioned therein. By pulling the handle 20 in an upstroke direction indicated by an arrow 140, the pull-up links 24 push the pull-up slide 94 against the bias of the spring 102 by the pin 96 pushing against the end 98 thereof. As the slide 94 moves in the direction 100, the gripper holder 108 and the wheel 116 move therewith. The movement in the direction 100 creates tension on the tail 134 of the band 12 and the wheel 116 is pulled in a direction indicated by an arrow 142. As the wheel 116 is forced in the direction 142 (see FIG. 4*b*), the knurled perimeter 118 thereof is forced against the tail 134 which is trapped therebetween and the gripper slide spacer 112. Thus, the gripping action of the wheel 116 pulls the tail 134 in the direction 100 with the slide 94 and holder 108.

As the tail 134 moves in the direction 100, the holding dog 62 is pivoted about the pin 64 against the bias of the spring 66 in the direction 136 (see FIG. 4*c*). Thus, the tail 134 passes the holding dog 62 while being securely gripped between the wheel 116 and the slide spacer 112. Upon completion of the travel of the slide 94 in the direction 100, the handle 20 is moved in a downstroke direction indicated by an arrow 144 by the spring 102 moving in the direction 104 to allow resetting of the tool 10 for another upstroke 140.

Figure 5C:
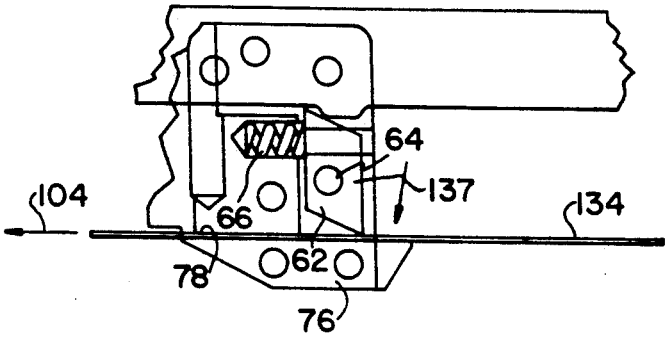
FIGS. 5*a, b* and *c* are cross-sectional views of the tool being activated for locking the band and the buckle.
Figure 5A:
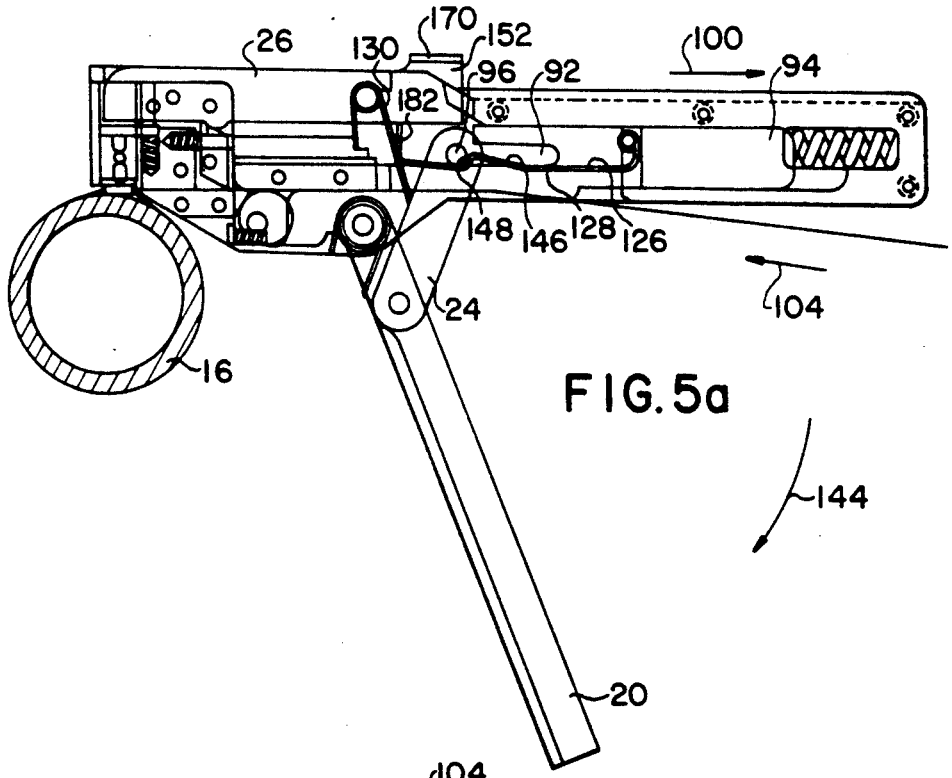
Figure 5B:
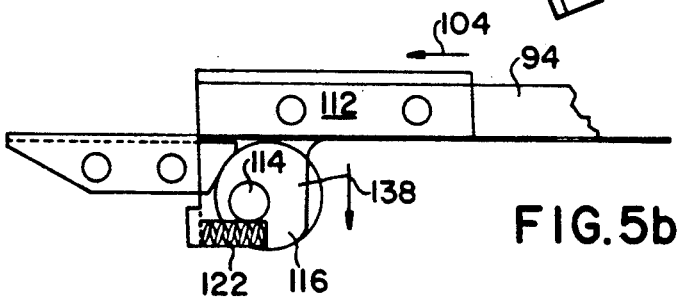

As the handle 20 moves in the direction 144, the slide 94 moves in the direction 104 (see FIGS. 5*a* and 5*b*). The movement of the slide 94 in the direction 104 causes the wheel 116 to pivot about the pin 114 in the direction 138 (see FIG. 3*c*) against the bias of the spring 122. The movement of the wheel 116 in the direction 138 is aided by the dog 62 holding the tail 134 from movement in the direction 104, and therefore, the wheel 116 and the gripper slide spacer 112 slide past the tail 134.

The dog 62 holds the tail 134 from movement due to the tension on the tail 134 which tends to try to force the tail 134 in the direction 104. The tension therein pulls the dog 62 (aided by the biasing of the spring 68) in a direction 137 (see FIG. 5*c*) thus forcing the dog 62 into the tail 134. Since the top surface 78 of the nose 76 is directly therebelow, the tail 134 is securely gripped and prevented from back slippage in the direction 104.

The upstroke 140 and downstroke 144 sequence just described is repeated until the band 12 is sufficiently tensioned around the object 16. Since there is no automatic tension setting signal device in the tool 10, it is necessary to tension the band 12 by "feel." Once the correct tension is "felt", the band 12 must be properly secured to the buckle 14, and one tail 134 of the band 12 must be severed therefrom.

Referring to FIG. 5*a*, the tool 10 is shown with the handle 20 in position to manipulate the locking/cutting lever 26. The handle 20 has been moved in the downstroke direction 144 until the pin 96 is removed from the slot 92 of the pull-up slide 94. As the pin 96 exits the slot 92, it rides along a sloped portion 146 of the spring 126 which is pushed deeper into the slot 128 of the slide 94 to allow the pin 96 to pass thereby. Upon exiting the slot 92, the pin 96 drops in front of a bent portion 148 of the spring 126 which then rises back out of the slot 128. By proper manipulation of the links 24 (the pin 96 of the links 24 is pushed in the direction 104) the pin 96 comes into contact with the locking/cutting lever 26.

Figure 6A:
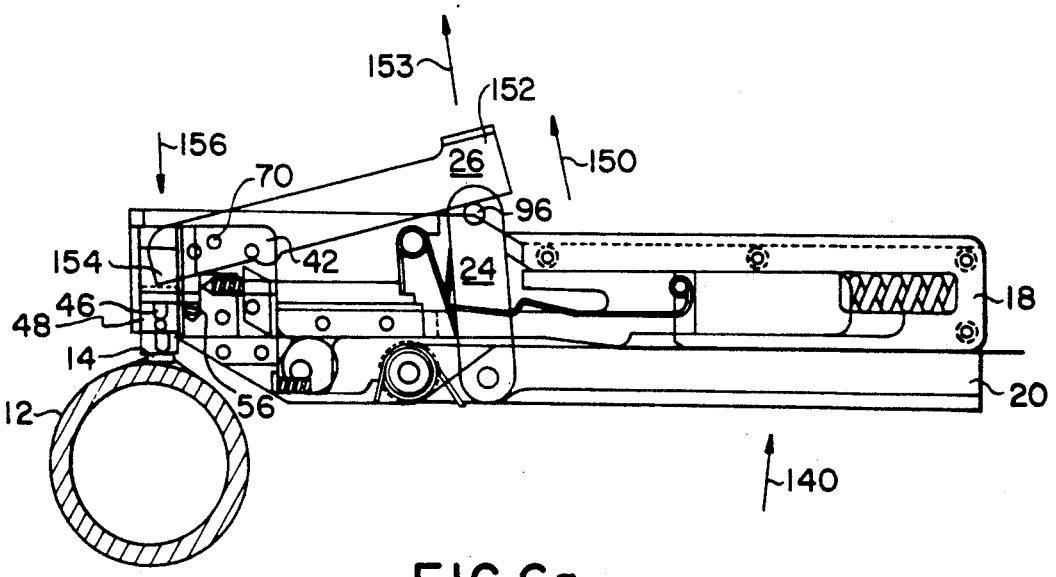
FIGS. 6*a, b, c, d, e, f* and *g* are views of the tool through the dimpling, bending and cutting sequence.

Referring to FIG. 6*a*, the handle 20 has been moved in the upstroke direction 140 into contact with the housing 18. The movement of the handle 20 in the upstroke direction 140 causes the links 24 to move generally in a direction indicated by an arrow 150. Simultaneously, the pin 96 (being in contact with the lever 26) pivots the lever 26 about the pin 70 within the head 42. An end 152 of the lever 26 is thus moved generally in a direction indicated by an arrow 153 while an opposite end 154 thereof is moved generally in a direction indicated by an arrow 156.

Figure 6C:
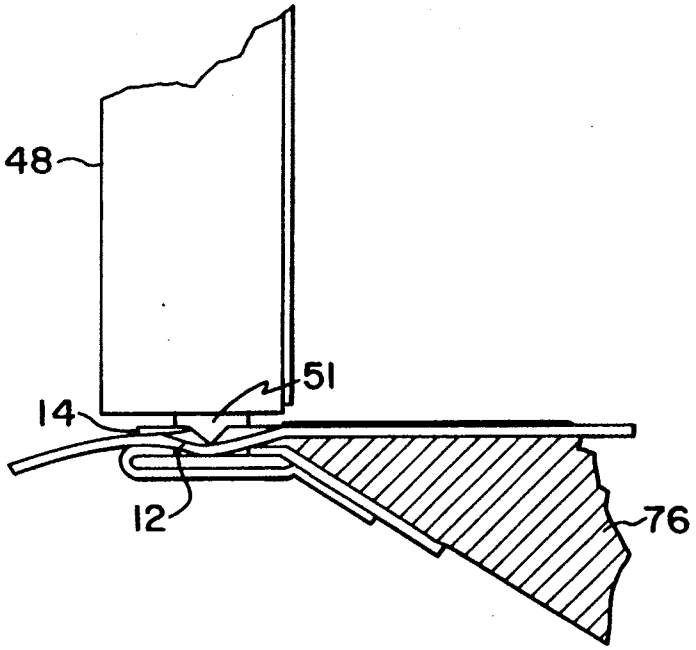
Figure 6B:
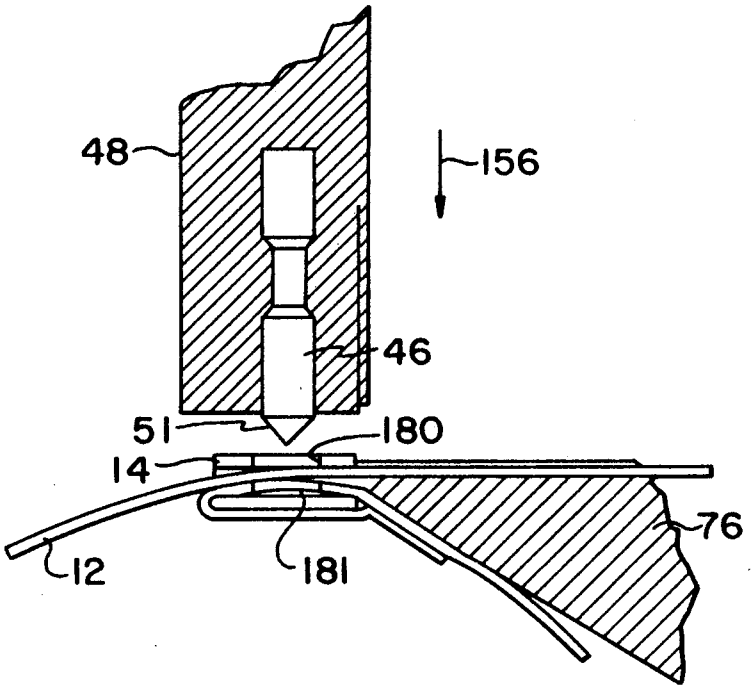

As the opposite end 154 of the lever 26 moves in the direction 156, the cutter/punch holder 48 and the punch 46 are also moved in the direction 156 against the bias of the spring 56. The punching end 51 of the punch 46 which protrudes beyond the head 42 first comes into contact with the band 12 through the hole 180 in the buckle 14 (see FIG. 6*b* and 6*c*). There is sufficient force in the punch 46 to deform the band 12 into interference with the second hole 181 in the band 12.

Figure 6E:
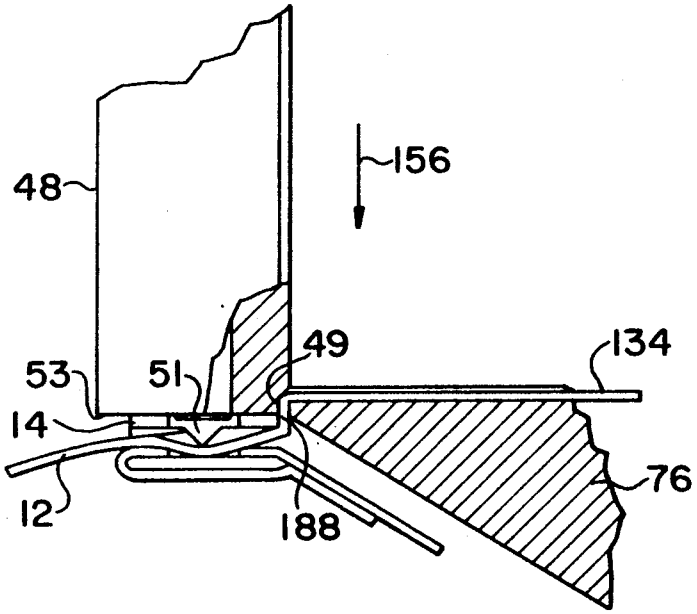
Figure 6D:
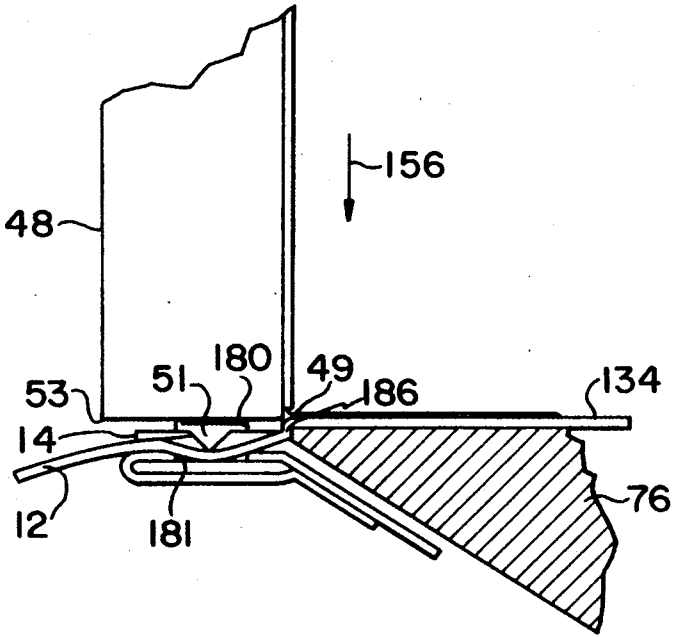

Referring to FIG. 6*d*, continued movement of the cutter/punch holder 48 in the direction 156 causes contact between the buckle 14 and the bottom surface 53 thereof. A space between the nose 76 and a surface 49 of the holder 48 allows the band 12 to go upward therein as the holder 48 continues in the direction 156. Thus, a partial locking lip 186 is formed between the surface 49 of the holder 48 and the hose 76.

Referring to FIG. 6*e*, continued movement of the holder 48 in the direction 156 causes contact between the surface 49 and the band 12. The surface 49 further bends the band 12 therebetween and the nose 76 to form a full locking lip 188. Upon completion of travel of the holder 48 in the direction 156, the tail 134 is severed from the full locking lip 188 of the band 12 (see FIG. 6*f*). The severing action is caused by the cutter edge 190 of the holder 48 sliding past the edge 82 of the nose 76.

Figure 6G:
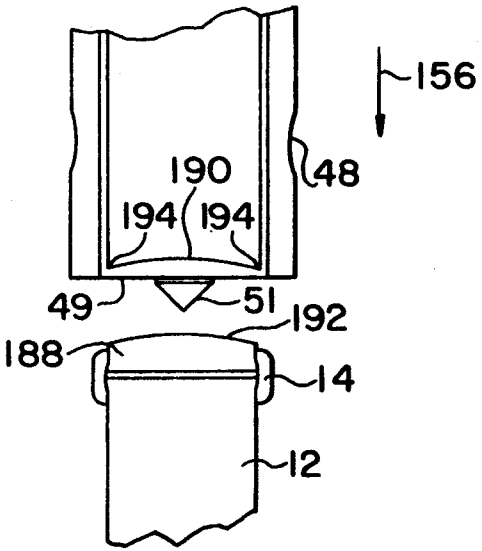
Figure 6F:
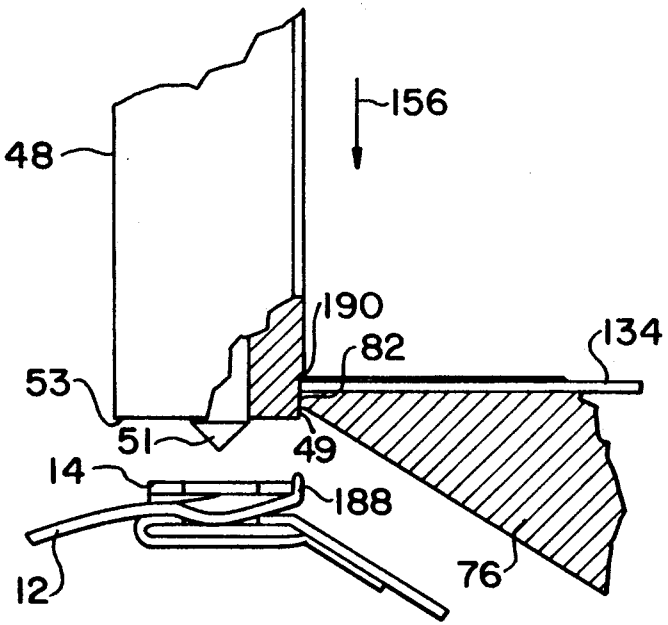

Referring to FIG. 6*g*, the full lip 188 has an arcuate edge 192. As the holder 48 moves in the direction 156, the cutter edge 190 first contacts the band 12 at ends 194 thereof. Continued movement in the direction 156 causes gradually more of the cutter edge 190 to contact the band 12 thus forming the arcuate edge 192. It is an advantage of the present invention that the arcuate edge 192 is formed resulting in corners thereof being reduced in sharpness.

Figure 7:
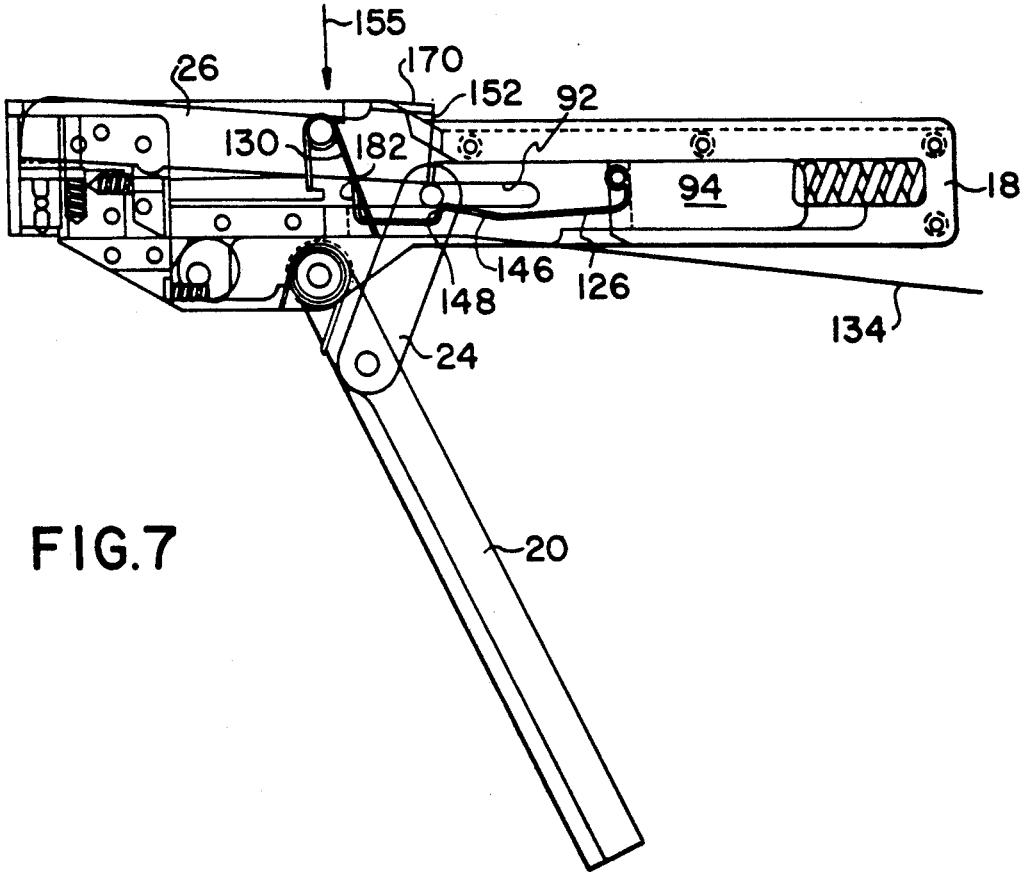
FIG. 7 is a cross-sectional view of the tool being returned to the tensioning condition, and removal of the tail.

By pressing the flanges 170 on the end 152 of the lever 26 in a direction 155 (see FIG. 7), the handle 20 moves in the downstroke direction 144 to place the pin 96 and links 24 back into the position shown in FIG. 6*a*. The spring 126 is pressed deeper into the slot 128 by contact between the lever 26 and pins 182 of the spring 126. Further manipulation in the direction 100 pushes the links 24 to position the pin 96 back in the slot 92. If long enough, the severed portion of the tail 134 may then be pulled from the tool 10, and the buckle 14 has been secured to the band 12 by the tool 10. If the tail 134 is not long enough to be pulled from the tool 10, the tool 10 may be positioned vertically and several actuations of the handle 20 will allow gravity to pull the tail 134 therethrough. If the tail 134 is not removed by gravity, insertion of another band 12 into the tool 10 will push the severed tail 134 therefrom.

Thus, the tool 10 has tensioned and secured the band 12 and the buckle 14 around the object 16. Since the tool 10 has relatively few parts, it is simple to manufacture, assemble and operate. While the above description has been in conjunction with a free/open end band and clamp, it is to be understood that it is possible to use the tool 10 with a preformed clamp.

Although the present invention has been described with respect to a specific preferred embodiment thereof, various changes and modifications may be suggested to one skilled in the art. Hence, it is intended that the present invention encompass such changes and modifications as fall within the scope of the appended claims.

I claim:

1. A banding tool for use with a band and a buckle, comprising:

means for tensioning the band including an operating handle;

means for use in locking the band to the buckle, said means for use in locking includes means for placing a portion of said means for use in locking in a condition so that the band can be positioned for operation upon by the banding tool, wherein said means for use in locking is operatively connected to said operating handle and said means for use in locking comprises:

a punch holder;

a first cutting edge on said punch holder;

a nose; and a second cutting edge on said nose opposite and spaced apart from said first cutting edge, wherein the band is first bent and then cut between said first and second cutting edges as said space therebetween is gradually closed; and wherein, after the band is placed in an operative condition, the band is tensioned and locked to the buckle in a tensioning condition by manipulation of only said operating handle.

2. The tool of claim 1, wherein said means for tensioning comprises:

a spring biased pivoting lever arm, wherein as said means for tensioning pulls the band, said arm allows the band to pass, and when said means for tensioning releases the band, said arm is biased to hold the band.

3. The tool of claim 1, wherein said means for use in placing comprises:

a spring for biasing said portion of said means for use in locking in a first direction; and means for moving said portion of said means for use in locking in a second direction opposite said first direction to lock the band to the buckle.

4. The tool of claim 1, wherein:

said means for placing comprises a pivoting lever operatively connected to said operating handle.

5. The tool of claim 4, wherein said first cutting edge comprises an arcuate surface protruding from said punch holder, wherein the band is cut into an arcuate shape.

6. A banding tool for use with a band and a buckle, comprising:

means for tensioning the band including an operating handle, said means for tensioning comprises an eccentric wheel rotatably mounted in a sliding housing, said wheel biased in a first direction to securely hold the band, and actuating means for moving said sliding housing;

means for preventing slippage of the band during tensioning thereof;

means for forming a deformation on the band for locking cooperation with the buckle, said means for forming being included with the tool and operatively connected to said operating handle; and means for bending and cutting a tail of the band proximate the buckle, said means for bending and cutting operatively connected to said operating handle, wherein the band is locked in a tensioned condition by said means for forming a deformation and said means for bending and cutting.

7. The tool of claim 6, wherein said actuating means comprises:

said operating handle; and linkage between said handle and said sliding housing, wherein as said handle is moved said linkage moves said sliding housing.

8. The tool of claim 7, wherein said sliding housing comprises:

a slot for receiving said linkage;

an extension end; and a gripper slide spacer within said extension end for gripping cooperation with said eccentric wheel.

9. A banding tool for use with a free/open end band and buckle, comprising:

a housing including first and second elongated sections secured together to form a plurality of chambers therein;

a pull-up handle operatively connected to said housing;

a tensioning system at least partly contained within said housing, said system operatively connected to said handle;

a tension holding dog cooperating with said system;

a cutter/punch holder at least partly contained within said housing, wherein said holder includes a lever for placing a portion of said holder in a condition so that the band can be positioned for operation upon by the banding tool wherein said holder is operatively connected to said handle; and a punch within said holder, said plurality of chambers for receiving said system, said dog, said punch and said holder;

wherein, after the band is placed in an operative condition, the band is tensioned, cut and secured in a tensioned condition by manipulation of only said handle.

10. The tool of claim 9, wherein:

said lever is operatively connected to said handle and used for actuating said punch and said cutter/punch holder.

11. A banding tool for use with a free/open end band and buckle, comprising:

a housing;

a pull-up handle operatively connected to said housing;

a tensioning system contained within said housing, said system operatively connected to said handle;
a tension holding dog cooperating with said system;
a cutter/punch holder within said housing and operatively connected to said handle;
a punch within said holder;
a pull-up slide within said housing;
a pair of links pinned at a first end to said handle and operatively connected at a second end to said pull-up slide; and
a slide spring for biasing said slide in a non-tensioning position;
wherein as said handle is manipulated the band is tensioned by said system until the band is cut and secured in a tensioned condition by further manipulation of said handle.

12. The tool of claim 11, wherein said handle further includes:
a handle spring for cooperating with said slide spring to bias said handle in said non-tensioning position.

13. A banding tool for use with a free/open end band and buckle, comprising:
a housing;
a pull-up handle operatively connected to said housing;
a tensioning system contained within said housing, said system operatively connected to said handle and further comprises:
a gripper holder movable received within said housing;
a wheel eccentric about an access passing therethrough, said wheel pivotally mounted to said holder and having a roughened perimeter;
a support surface opposite said wheel and interconnected to said gripper holder, wherein the band passes between said wheel and said support surfaces; and
a spring for biasing said wheel into gripping contact with said support surface;
a tension holding dog cooperating with said system;
a cutter/punch holder within said housing and operatively connected to said handle; and
a punch within said holder, wherein as said handle is manipulated the band is tensioned by said system until the band is cut and secured in a tensioned condition by further manipulation of said handle.

14. The tool of claim 13, wherein said support surface comprises:
a gripper slide spacer fixed within an extension end of a pull-up slide, said extension end also having said gripper holder fixed thereto.

15. A banding tool for use with a free/open end band and buckle, comprising:
a housing;
a pull-up handle operatively connected to said housing;
a tensioning system at least partly contained within said housing, said system operatively connected to said handle;
a tension holding dog cooperating with said system, said dog further including:
a pin for pivotally attaching said dog within said cutter/punch holder; and
a spring for biasing said dog to hold the band from slipping until the band is secured in said tensioned condition;
a cutter/punch holder at least partly contained within said housing, wherein said holder includes a lever for placing a portion of said holder in a condition so that the band can be positioned for operation upon by the banding tool wherein said holder is operatively connected to said handle; and
a punch within said holder;
wherein, after the band is placed in an operative condition, the band is tensioned, cut and secured in a tensioned condition by manipulation of only said handle.

16. A banding tool for use with a free/open end band and buckle, comprising:
a housing;
a pull-up handle operatively connected to said housing;
a tensioning system at least partly contained within said housing, said system operatively connected to said handle;
a tension holding dog cooperating with said system;
a cutter/punch holder at least partly contained within said housing, said cutter/punch holder including a bending/cutting edge thereon for first bending and then cutting the band, wherein said holder includes a lever for placing a portion of said holder in a condition so that the band can be positioned for operation upon by the banding tool wherein said holder is operatively connected to said handle; and
a punch within said holder;
wherein, after the band is placed in an operative condition, the band is tensioned, cut and secured in a tensioned condition by manipulation of only said handle.

17. The tool of claim 16, wherein said bending/cutting edge further comprises an arcuate cutter for forming an arcuate cut in the band.

18. A method for tensioning and securing a clamp of the type having a band and a buckle thereon with a banding tool, comprising the steps of:
placing the banding tool in an initial condition so that the clamp can be subsequently positioned for operation upon by the banding tool;
positioning the band for operation upon by the banding tool;
tensioning the band with a tensioning assembly after said step of positioning;
preventing slippage of the band with a tension holding dog while the band is under tension;
forming a locking deformation on the band with a punch including in the tool for locking cooperation with the buckle;
bending the band proximate the buckle; and
cutting the band proximate the buckle;
wherein said steps of forming, bending, and cutting are accomplished by manipulating only a single handle of the banding tool and said steps of bending and cutting comprise moving a bending/cutting edge of a punch holder into contact with a first side of the band after said step of forming a locking deformation and forcing a second side of the band into contact with a nose opposite said punch holder, wherein the band is first bent and then cut between said cutting edge and said nose.

19. The method of claim 18, wherein the step of preventing slippage comprises:
gripping the band between said holding dog and a nose therebelow.

20. The method of claim 18, wherein at least one of said steps of forming, bending, and cutting comprises:

pivoting a cut-off lever operatively connected to said handle into contact with a holder containing said included punch; and forcing said punch into contact with the band by said lever.

21. The method of claim 18, further comprising the step of:

progressively contacting said first side of the band with an arcuate cutter of said bending/cutting edge to form an arcuate cut in the band.

22. A method for tensioning and securing a clamp of the type having a band and a buckle thereon with a banding too, comprising the steps of:

manipulating a handle of a tensioning assembly to tension the band;

preventing slippage of the band with a tension holding dog; and further manipulating said handle to form a locking deformation on the band with a punch including in the tool and operatively connected to said handle for locking cooperation with a buckle, to bend the band proximate the buckle, and to cut the band proximate the buckle, wherein the band is secured in a tensioned condition by said step of further manipulating, wherein the step of manipulating further comprises:

gripping the band between an eccentric wheel and a support surface; and sliding said wheel and said surface in a direction to pull the band into a tensioned condition.

23. A method for forming a banding tool, comprising the steps of:

forming a housing having a plurality of chambers therein;

pivotally attaching a pull-up handle to said housing;

operatively connecting a tensioning system to said handle, wherein said step of operatively connecting comprises the steps of:

pivotally attaching a first end f a tensioning link to said handle;

operatively connecting a second end of said link to a pull-up slide slidably received within said housing;

fixing a gripper holder to said slide; and rotatably fixing an eccentric wheel to said gripper holder, wherein said band clamp is gripper between said wheel and said slide for tensioning; and operatively connecting a punch holder to said handle, said holder comprising a punch and a bending/cutting edge, wherein a band clamp can be tensioned and clamped around an object by the banding tool.

24. The method of claim 23, further comprising the step of:

fixing a gripper assist surface within said slide wherein said band clamp is gripped between said wheel and said gripper assist surface.

25. A method for tensioning and securing a clamp of the type having a band and a buckle thereon with a banding tool, comprising the steps of:

placing the banding tool in an initial condition so that the clamp can be subsequently positioned for operation upon by the banding tool;

positioning the band for operation upon by the banding tool;

tensioning the band with a tensioning assembly after said step of positioning;

preventing slippage of the band with a tension holding dog while the band is under tension;

forming a locking deformation on the band with a punch included in the tool for locking cooperation with the buckle, said step of forming a locking deformation further comprising:

penetrating a first hole in the buckle overlying the band with said punch; and forcing the band into a second hole in the band underlying said first hole with said punch to lock the band to the buckle with said deformation;

bending the band proximate the buckle; and cutting the band proximate the buckle;

wherein said steps of forming, bending, and cutting are accomplished by manipulating only a single handle of the band tool.

* * * * *